US005397367A

United States Patent [19]

Fey et al.

[11] Patent Number: 5,397,367

[45] Date of Patent: Mar. 14, 1995

[54] MIDDLE DISTILLATE HYDROCARBON FOAM CONTROL AGENTS FROM CROSS-LINKED ORGANOPOLYSILOXANE-POLYOXYALKYENES

[75] Inventors: Kenneth C. Fey, Midland; Christopher S. Combs, Saginaw, both of Mich.

[73] Assignee: Dow Corning Corporation, Midland, Mich.

[21] Appl. No.: 155,392

[22] Filed: Nov. 19, 1993

[51] Int. Cl.[6] ..... C10L 1/28

[52] U.S. Cl. ..... 44/320

[58] Field of Search ..... 44/320; 252/321, 351, 252/358

[56] References Cited

U.S. PATENT DOCUMENTS

| | | | |
|---|---|---|---|
| 2,862,885 | 12/1958 | Nelsen et al. | 252/49.6 |
| 2,917,480 | 12/1959 | Bailey et al. | 260/42 |
| 2,992,083 | 7/1961 | Bluestein et al. | 44/72 |
| 3,057,901 | 10/1967 | Plueddemann | 260/448.2 |
| 3,233,986 | 2/1966 | Morehouse et al. | 44/76 |
| 4,690,688 | 9/1987 | Adams et al. | 44/76 |
| 4,844,826 | 7/1989 | Schafer et al. | 252/49.6 |
| 4,853,474 | 8/1989 | Bahr et al. | 556/445 |
| 5,017,221 | 5/1991 | Legrow et al. | 106/2 |
| 5,160,494 | 11/1992 | Krzysik et al. | 512/3 |
| 5,192,336 | 3/1993 | Grewal | 44/418 |

*Primary Examiner*—Prince Willis, Jr.
*Assistant Examiner*—Cephia D. Toomer
*Attorney, Agent, or Firm*—Richard I. Gearhart

[57] ABSTRACT

Organosilicone materials that are "density-matched" to the hydrocarbon medium also act as defoamers in hydrocarbon fuel, specifically as described herein for diesel fuel. Specifically these new defoamers can be described as cross-linked organopolysiloxane-polyoxyalkylenes. They have the characteristics of being slightly soluble or insoluble in water and hydrocarbon fuels. By changing the solvent and the method of dispersion, different particle size distributions are obtained.

22 Claims, No Drawings

MIDDLE DISTILLATE HYDROCARBON FOAM CONTROL AGENTS FROM CROSS-LINKED ORGANOPOLYSILOXANE-POLYOXYALKYENES

FIELD OF THE INVENTION

This invention relates to foam control and is particularly concerned with controlling foaming in hydrocarbon liquids.

BACKGROUND OF THE INVENTION

There are a number of patents which disclose specific compositions which reduce or eliminate this foam. For example, U.S. Pat. No. 5,192,336 assigned to Nalco, discloses that bis-strearamides act as defoamers by remaining dispersed within the fuel. This is in contrast to silicone polyether defoamers, as claimed in U.S. Pat. No. 4,690,668 assigned to Dow Corning and in U.S. Pat. No. 3,233,986 assigned to Union Carbide, which because of their higher density relative to hydrocarbon fuel settle out of the fuel over time, potentially rendering them less effective without periodic agitation to re-disperse them. Silicone polyethers also can suffer from the fact that they tend to be more soluble or dispersible in water, a constant component of hydrocarbon fuels. In storage tanks, water tends to coalesce, forming a layer at the bottom of the tank. As the silicone polyether settles and its insolubility in the hydrocarbon, eventual contact with the water layer can result in its being absorbed into that phase, thus irreversibly removing it from the fuel entirely.

Current middle distillate fuels exhibit foaming during transfer operations, such as filling a vehicle's fuel tank at a filling station. In the processing, transportation and storage of hydrocarbon liquids, it is frequently observed that foaming occurs as the liquid is passed from one vessel to another. For example, as liquid hydrocarbon fuel is passed quickly into a storage tank a foam may develop at the surface of the fuel and, in many cases, the extent of foaming is sufficiently significant and persistent to require a reduction in the rate of passage of the liquid fuel into the vessel. It is highly desirable to provide means for controlling foaming so as to permit high rates of passage.

Various proposals have been made for controlling foaming of various grades of hydrocarbon liquids by use of additives for example silicone products. However, the reduction of foaming of diesel fuels by use, in extremely small quantities, of technically acceptable silicone additives has not been satisfactorily solved prior to this invention.

U.S. Pat. No. 3,233,986 is concerned with siloxane polyoxyalkylene block copolymers as antifoam agents and discloses the use of a wide variety of such copolymers to reduce the tendency of organic liquids to foam. Organic liquids mentioned in said specification include inter alia various hydrocarbon liquids including liquid hydrocarbon fuels e.g. kerosene, gasoline and diesel fuel. Among the many copolymers advocated in said specification are those comprising groups represented by the formula:

$$G^3(OG'')_nOG'\overset{\overset{G_c}{|}}{Si}O_{\frac{3-c}{2}}$$

wherein $G^3$ is a member selected from the group consisting of the hydrogen atom and the monovalent hydrocarbon groups, G'' is an alkylene radical containing at least two carbon atoms, G' is a divalent hydrocarbon radical, G is a monovalent hydrocarbon radical, n has a value of at least two and c has a value from 0 to 2 inclusive.

U.S. Pat. No. 3,233,986 teaches that at least 60% by weight of the groups OG'' must be oxyethylene or oxypropylene groups and that other oxyalkylene groups may be present in the groups OG''. It is said that each oxyalkylene block preferably contains from four to thirty groups OG''. The specification teaches that the number of oxyalkylene groups (OG'') and that part of the average molecular weight of the copolymer that is attributable to the oxyalkylene blocks is not critical, and that useful copolymers can contain siloxane blocks and oxyalkylene blocks in any relative amount.

U.S. Pat. No. 3,233,986 states that the amount of the copolymers used with a liquid hydrocarbon is not critical and can range from 5 to 2000 parts by weight of the copolymer per million parts of the liquid.

Some copolymers of the type disclosed in U.S. Pat. No. 3,233,986 when employed in certain hydrocarbon fuels, particularly when used in amounts of less than 100 parts copolymer per million parts hydrocarbon, do not act to reduce the tendency of the hydrocarbon to foam but rather to increase the tendency of the hydrocarbon to foam.

SUMMARY OF THE INVENTION

This invention discloses that organosilicone materials that are "density-matched" to the hydrocarbon medium also act as defoamers in hydrocarbon fuel, specifically as described herein for diesel fuel. Specifically these new defoamers can be described as cross-linked organopolysiloxane-polyoxyalkylenes. They have the characteristics of being slightly soluble or insoluble in water and hydrocarbon fuels. By changing the solvent and the method of dispersion, different particle size distributions of the organopolysiloxane-polyoxyalkylenes are obtained.

By using materials that do not readily settle from the hydrocarbon due to gravity, and which are sparingly soluble or only dispersible in water, these defoamers do not lose their defoaming capability during storage as readily as conventional silicone polyethers which rapidly settle from the fuel and which are more soluble in water.

The preferred embodiment of the density matched cross-linked organopolysiloxane-polyoxyalkylene is selected from the group of compounds consisting essentially of:

$$\left[\begin{array}{c} R'''(Me)_2SiO(MeRSiO)_x(MeSiO)_c \\ | \\ (Me_2SiO)_z \\ | \\ R'''(Me)_2SiO(MeSiO)_y \\ | \\ R''(OCH_2-CH(Me))_b(OCH_2-CH_2)_a-O-(CH_2)_3 \end{array}\right]_2 \Bigg]-(CH_2CHR_1R'CHR_1CH_2)-,$$

-continued

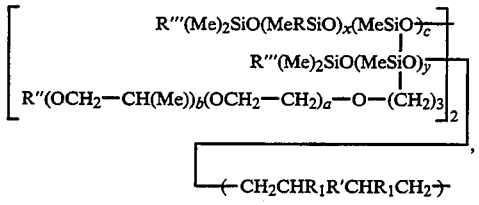

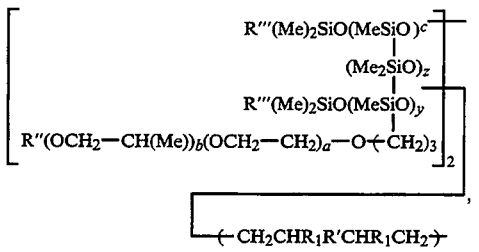

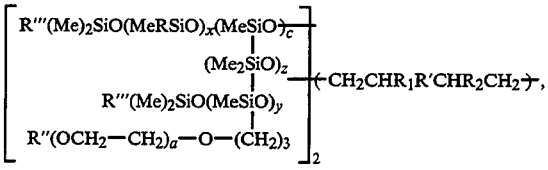

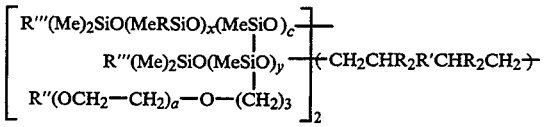

and

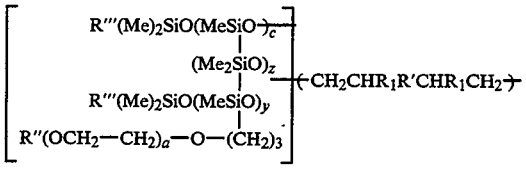

where:

Me is $CH_3$—;

R is 2 to 25 aliphatic carbon radicals;

R′ is selected from a group consisting essentially of:

(i) divalent organic radicals, and (ii) divalent organosiloxane groups, wherein (i) and (ii) do not contain hydrolyzable groups;

R″ is a terminal group;

R‴ is independently selected from the group consisting essentially of:

(i) hydrogen, and (ii) aliphatic carbon radicals having 1 to 25 carbon atoms;

$R_1$ is independently selected from the group consisting essentially of:

(i) hydrogen, and (ii) aliphatic carbon radicals having 1 to 3 carbon atoms;

each $x=1-200$;

each $c=1-5$;

each $z=1-600$;

each $y=1-40$;

$x+y+z \geqq 10$;

each $a=4-40$; and each $b=1-40$.

The aliphatic radicals represented by R may include any of the $C_2$ to $C_{50}$ open-chain paraffin olefin, and acetylenic hydrocarbons with paraffinic hydrocarbons being preferred such as, for example, ethyl, propyl, hexyl, decyl, dodecyl, octadecyl, and eicosyl.

The organic groups represented by R′ may include for example $C_1$ to $C_{10}$ alkylene radicals such as methylene, dimethylene, trimethylene, pentamethylene and decamethylene; cycloalkylene radicals such as cyclohexylene; divalent aromatic radicals such as p-phenylene or o-phenylene; and oxygen containing radicals such as —COO $CH_2CH_2OOC$— and —$CH_2OCH_2$—.

The terminal group represented by R″ may include acyl radicals of $C_1$ to $C_{20}$, for example, acetyl, propionyl, butyryl, isobutyryl, lauroyl, myristoyl, and stearoyl 3-carboxypentadecanoyl; alkyl radicals of $C_1$ to $C_{10}$ such as methyl, ethyl, propyl, butyl, and decyl; and the hydrogen atom. Other terminating groups possessing substantially the same properties as the above illustrative examples and which are prepared in a similar manner and which function in an equivalent manner may also be used.

The aliphatic radical represented by R‴ may include any of the radicals illustrated above for R, but also includes the methyl radical.

The unit of the cross-linking radical represented by $R_1$ may include the hydrogen atom and monovalent $C_1$ to $C_3$ aliphatic radicals such as methyl, ethyl and propyl.

PREFERRED EMBODIMENT OF THE INVENTION

While the invention is susceptible of embodiment in many different forms there is described herein in detail preferred and alternate embodiments of the invention. It should be understood, however, that the present disclosure is to be considered an exemplification of the principles of the invention and is not intended to limit the spirit and scope of the invention and/or claims of the embodiments illustrated.

The present invention comprises adding density matched, cross-linked organopolysiloxane-polyoxyalkylenes polymers to hydrocarbon liquid to reduce the tendency of the hydrocarbon liquid to produce foam. These polymers have the characteristics of being slightly soluble or insoluble in water and hydrocarbon fuels. By changing the solvent and the method of dispersion, different particle size distributions of the organopolysiloxane-polyoxyalkylenes are obtained.

The cross-linked organopolysiloxane-polyoxyalkylenes are density matched to the hydrocarbon liquid. By density matched, it is meant that the polymers have a density roughly approximating the density of the hydrocarbon liquid. The density of most of the cross-linked organopolysiloxane-polyoxyalkylenes are in the range of the described hydrogen liquids, generally 0.8 to 0.9 g/cm$^3$. By using materials that do not readily settle from the hydrocarbon due to gravity, and which are sparingly soluble or only dispersible in water, these defoamers do not lose their defoaming capability during storage as readily as conventional silicone polyethers which rapidly settle from the fuel and which are more soluble in water.

Hydrocarbon fuels of particular interest in the context of the present invention are diesel fuel and jet fuel. The hydrocarbon fuel is preferably a diesel fuel used as a fuel for motor vehicles, e.g. cars and heavy goods vehicles, and marine use, or a jet fuel. By the expression "diesel fuel" where used herein is meant gas oil and fuel oil including those materials which are referred to as light domestic and heating oils and diesel fuel and irrespective of whether they are intended for vehicular, marine, heating or other use. These materials are loosely characterized as having a viscosity of not more than 115" Redwood 1 at 38° C. and a boiling point in the range of about 200° C. to about 380° C. Particularly embraced within the expression are those hydrocarbon liquids having a viscosity of about 30 to 40" Redwood at 38° C., including those having a viscosity at 20° C. in the range of about 2.9 to about 10.2 centistokes, and at 38° C. in the range of about 1.6 to about 6.0 cS. Further, these materials have a carbon residue (Conradson) of <0.2% by weight, a water content of <0.05% by weight, a sulphur content of <1.0% by weight and a net calorific value of about 10100 to about 10300 Kcal/Kg.

By the expression "jet fuel" where used herein is meant kerosene, light oils and medium oils for example that known as AVTUR fuel. AVTUR fuel is a medium oil distilling between 150° and 300° C. that distills at least 65% in volume at 250°, has a flash point above 38° C., has a maximum aromatic content of 20% by volume, has been treated to have a kinematic viscosity of less than 15 Cst (1.5×10−5 m2/s) at −34° C. and has a freezing point not greater and −50° C.

The present invention may also find use at least to a limited extent for controlling foaming of other hydrocarbon liquids, for example residual fuel oils having a viscosity at 38 d C. of greater than 115" Redwood 1, light medium and heavy naphtha, vaporizing oils and motor oils and motor spirits. The invention is particularly beneficial in the control of foaming of hydrocarbon liquids and especially diesel fuels as they are pumped rapidly from one vessel to another in the presence of air, and possibly in the presence of water. Such circumstances may occur for example during transfer of materials though a supply pipe from one vessel to another, as required during separation of various grades of hydrocarbon liquids from crude oil or separation of various grades of hydrocarbon liquid from selected feedstocks, and in transfer of hydrocarbon liquids from road tankers to static storage tanks.

Frequently hydrocarbon liquids have disposed therein various "additive packages". The additive packages contain corrosion inhibitors, anti-scaling agents, octane improvers, emulsifiers, detergents, etc., to improve overall engine performance. The types and quantities of these additives are well known to those skilled in the art.

The polymers of the present invention may be used in a method according to the invention in any desired quantity and incorporated into the hydrocarbon liquid in any suitable manner. The copolymers are added to the hydrocarbon liquid in the form of a solution or dispersion. The preferred copolymers are effective to reduce the tendency of hydrocarbon liquids to foam when used in quantities of 100 parts per million or less, for example in the range from about 1 to about 50 ppm by volume, the most preferred copolymers being effective when used in quantities of from 1 to 29.

The preferred embodiment of the cross-linked organopolysiloxane-polyoxyalkylene is selected from the group of compounds consisting essentially of:

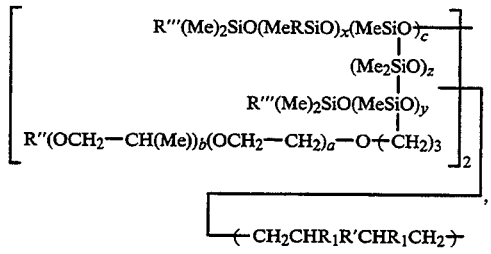

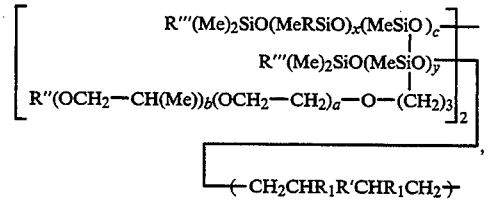

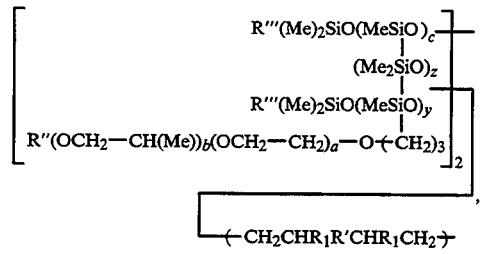

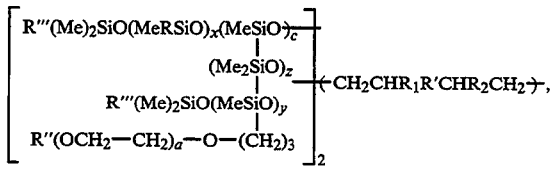

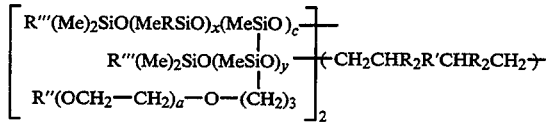

and

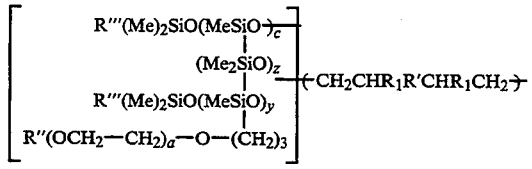

where:

Me is $CH_3$—;

R is 2 to 25 aliphatic carbon radicals;

R′ is selected from a group consisting essentially of:

(i) divalent organic radicals, and (ii) divalent organosiloxane groups, wherein (i) and (ii) do not contain hydrolyzable groups;

R″ is a terminal group;

R‴ is independently selected from the group consisting essentially of:

(i) hydrogen, and (ii) aliphatic carbon radicals having 1 to 25 carbon atoms;

$R_1$ is independently selected from the group consisting essentially of:

(i) hydrogen, and (ii) aliphatic carbon radicals having 1 to 3 carbon atoms;

each $x=1-200$;

each $c=1-5$;

each $z=1-600$;

each $y=1-40$;

$x+y+z \geqq 10$;

each $a=4-40$; and each $b=1-40$.

This general class of cross-linked organopolysiloxane-polyoxyalkylene can be found in U.S. Pat. No. 4,853,474 to Bahr, et al., which is incorporated herein by reference to show the general materials as well as their preparation.

The aliphatic radicals represented by R may include any of the $C_2$ to $C_{25}$ open-chain paraffin olefin, and acetylenic hydrocarbons with paraffinic hydrocarbons being preferred such as, for example, ethyl, propyl, hexyl, decyl, dodecyl, octadecyl, and eicosyl.

The organic groups represented by R′ may include for example $C_1$ to $C_{10}$ alkylene radicals such as methylene, dimethylene, trimethylene, pentamethylene and decamethylene; cycloalkylene radicals such as cyclohexylene; divalent aromatic radicals such as p-phenylene or o-phenylene; and oxygen containing radicals such as —COO $CH_2CH_2OOC$— and —$CH_2OCH_2$—.

The terminal group represented by R″ may include acyl radicals of $C_1$ to $C_{20}$, for example, acetyl, propionyl, butyryl, isobutyryl, lauroyl, myristoyl, and stearoyl 3-carboxypentadecanoyl; alkyl radicals of $C_1$ to $C_{10}$ such as methyl, ethyl, propyl, butyl, and decyl; and the hydrogen atom. Other terminating groups possessing substantially the same properties as the above illustrative examples and which are prepared in a similar manner and which function in an equivalent manner may also be used.

The aliphatic radical represented by R‴ may include any of the radicals illustrated above for R, but also includes the methyl radical.

The unit of the cross-linking radical represented by $R_1$ may include the hydrogen atom and monovalent $C_1$ to $C_3$ aliphatic radicals such as methyl, ethyl and propyl.

It is preferred that the cross-linking bond is not hydrolyzable, and that R′ contains no hydrolyzable bonds. In conventional organosiloxane-polyoxyalkylenes, some cross-linking may accidentally occur where the polyoxyalkylene is hydroxy terminated at one end. The hydroxy group may react with a silicon hydride creating a polyoxyalkylene bridge between two silicon backbone molecules as shown below:

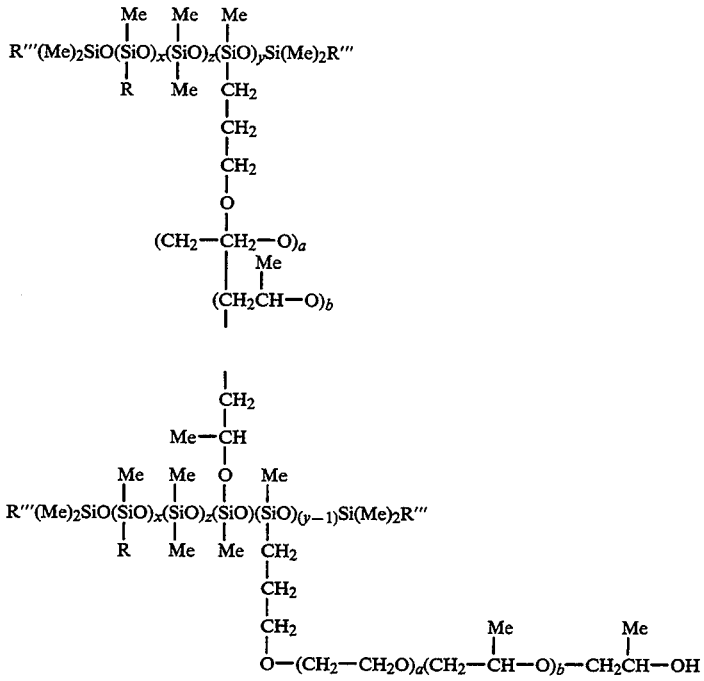

However, the degree to which this cross-linking may occur in the reaction process is not reliably predictable. Further, the SiOC bond formed at the hydroxy end of the bridge is subject to hydrolysis, especially under the extreme operating conditions described above. In contrast, the preferred bridge bond of the organopolysiloxane-polyoxyalkylene of the present invention is a saturated carbon-silicon bond which is not hydrolyzable and is highly stable. Further, the organic or organosiloxane body R′ of the cross-linking bridge is selected to be free of hydrolyzable bonds. Further, R′ should not interfere with the organopolysiloxane-polyoxyalkylene formation in any way. Preparation of these organopolysiloxane polyoxyalkyenes is fully disclosed in U.S. Pat. No. 4,853,474, said disclosure being incorporated herein by reference.

In a most preferred embodiment of the invention, the organopolysiloxane polyoxyalkylene selected as an antifoam is $Me3SiO[(C_{12}H_{25})CH_3SiO]_{38.5}$ $[RCH_3SiO]_{1.5}$ $SiMe_3$ where $R=(CH_2)_3$ $(CH_2CH_2O)_{18}$ $(CH_2CH(CH_3)O)_{18}H$. This antifoaming agent may be added directly to the hydrocarbon fuel, or may be predispersed in a predispersent such as the hydrocarbon liquid, xylene, toluene, naphtha, and other aromatic compounds, various ketones, ethers and other commonly used organic solvents. The preferred antifoam may be prepared in accordance with the procedures described in U.S. Pat. No. 4,853,474.

EXAMPLE

Two samples were prepared. For Sample A, 90 gm. of diesel fuel was weighed into a 16 oz. glass bottle. To this was added 10 ppm of $Me_3SiO[(C_{12}H_{25})CH_3SiO]_{38.5}[RCH_3SiO]_{1.5}SiMe_3$ where $R=(CH_2)_3(CH_2CH_2O)_{18}(CH_2CH(CH_3)O)_{18}H$ (the "antifoam agent"), predispersed as a 1% wt. solution in xylene. For Sample B, 90 gm. of diesel fuel was weighed into a 16 oz. glass bottle, and to this is added 10 ppm of the antifoam agent, predispersed as a 1% wt. solution in diesel fuel. The mixtures were then gently swirled to disperse the antifoam solution. Then 10 gm. of DI water was added to each bottle, and the contents of each were again gently swirled to allow for some limited contact between phases.

Fifty cc's of the fuel phase from each of the above samples were pipetted into separate 100 cc. graduated cylinders. The cylinders were then stopped with a glass stopper and the contents shaken 60–65 times during a one minute period. The foam volume immediately after shaking had stopped was recorded and the amount of time required for the foam to break and expose a clear section of liquid was measured. The foam height was then converted to a "Percent Foam Volume" using the following formula, which is relative to the original liquid volume of 50 cc:

$$100\times\{(\text{recorded foam volume}-50)\text{cc} / 50\ \text{cc}\}=\text{"Percent Foam Volume"}$$

TABLE I

| | DAY 1 | | DAY 7 | |
|---|---|---|---|---|
| | % Foam Volume | Break Time | % Foam Volume | Break Time |
| Sample A | +25% | 34 sec. | +24% | 41 sec. |
| Sample B | +23% | 43 sec. | +24% | 48 sec. |
| No Antifoam | +27% | 57 sec. | +25% | 47 sec. |

The table shows that the antifoam additive of Samples A and B reduce the break time by as much as 50% over untreated diesel fuel.

The foregoing specification describes only the preferred embodiment and the alternate embodiments of the invention. Other embodiments may be articulated as well. It is expected that others will perceive differences which while differing from the foregoing, do not depart from the spirit and scope of the invention herein described and claimed.

We claim:

1. A composition having a reduced tendency to foam consisting essentially of:

a hydrocarbon fuel; and a density matched organopolysiloxane-polyoxyalkylene in an amount of 100 parts per million or less by volume of hydrocarbon fuel, wherein said density matched organopolysiloxane-polyoxyalkylene is selected from the group consisting essentially of:

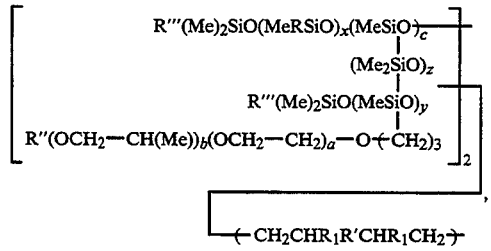

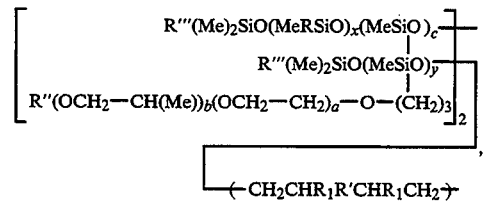

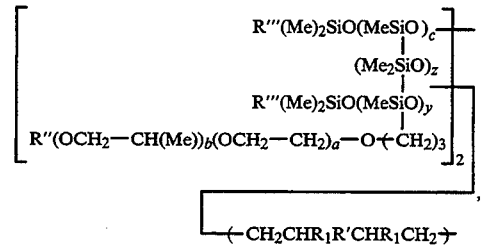

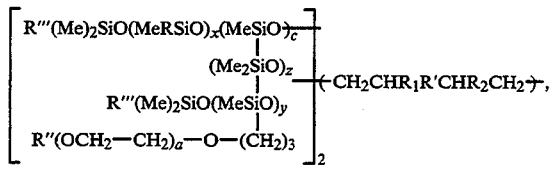

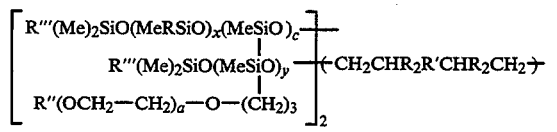

and

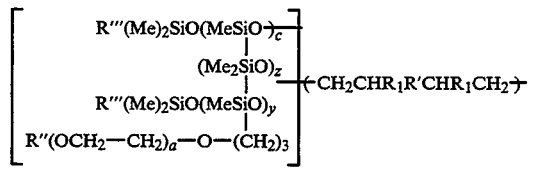

where:

Me is $CH_3$—;

R is 2 to 25 aliphatic carbon radicals;

R′ is selected from a group consisting essentially of:

(i) divalent organic radicals, and (ii) divalent organosiloxane groups, wherein (i) and (ii) do not contain hydrolyzable groups;

R″ is a terminal group;

R‴ is independently selected from the group consisting essentially of:

(i) hydrogen, and (ii) aliphatic carbon radicals having 1 to 25 carbon atoms;

$R_1$ is independently selected from the group consisting essentially of:

(i) hydrogen, and (ii) aliphatic carbon radicals having 1 to 3 carbon atoms;

each $x=1-200$;

each $c=1-5$;

each $z=1-600$;

each $y=1-40$;

$x+y+z \geqq 10$;

each $a=4-40$; and each $b=1-40$.

2. The composition of claim 1 wherein c is greater than 1 and there are up to six organopolysiloxane-polyoxyalkylene molecules cross-linked together.

3. The composition of claim 1 in which a cross-linker links the siloxane backbone of said organopolysiloxane-polyoxyalkylene molecules through a saturated silicon to carbon bond.

4. The composition of claim 3 in which said cross-linker is an organosiloxane radical.

5. The composition of claim 4 in which said cross-linker comprises divinyltetramethyldisiloxane.

6. The composition of claim 1, in which said hydrocarbon fuel includes an additive package.

7. The composition of claim 1, in which said hydrocarbon fuel is diesel fuel.

8. The composition of claim 1, in which said hydrocarbon fuel is jet fuel.

9. A method for reducing the amount of foam in a hydrocarbon fuel, comprising the step of:

adding to a hydrocarbon fuel, where said hydrocarbon fuel is diesel fuel or jet fuel, an antifoaming agent which is a density matched organopolysiloxane-polyoxyalkylene selected from the group consisting essentially of:

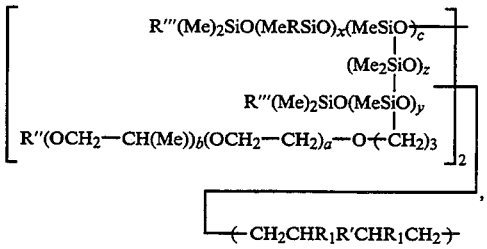

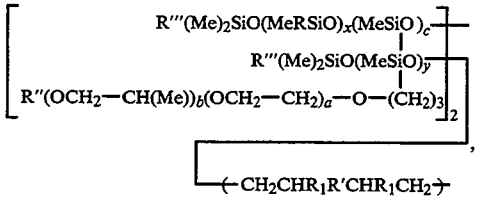

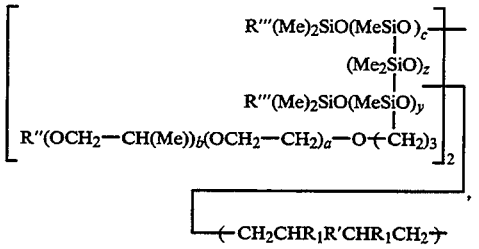

-continued

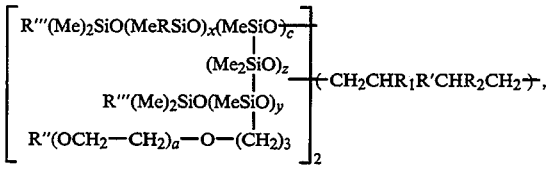

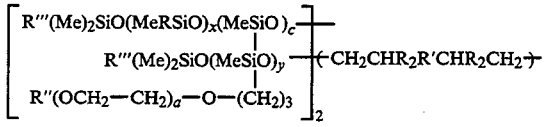

and

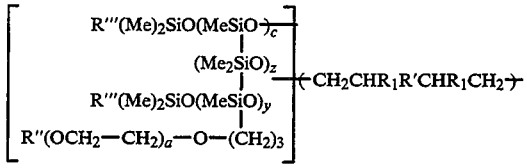

where:

Me is $CH_3$—;

R is 2 to 25 aliphatic carbon radicals;

R′ is selected from a group consisting essentially of:

(i) divalent organic radicals, and (ii) divalent organosiloxane groups, wherein (i) and (ii) do not contain hydrolyzable groups;

R″ is a terminal group;

R‴ is independently selected from the group consisting essentially of:

(i) hydrogen, and (ii) aliphatic carbon radicals having 1 to 25 carbon atoms;

$R_1$ is independently selected from the group consisting essentially of:

(i) hydrogen, and (ii) aliphatic carbon radicals having 1 to 3 carbon atoms;

each $x=1-200$;

each $c=1-5$;

each $z=1-600$;

each $y=1-40$;

$x+y+z \geqq 10$;

each $a=4-40$; and each $b=1-40$.

10. The method of claim 9 wherein c is greater than 1 and there are up to six organopolysiloxane-polyoxyalkylene molecules cross-linked together.

11. The method of claim 9 in which a cross-linker links the siloxane backbone of said organopolysiloxane-polyoxyalkylene molecules through a saturated silicon to carbon bond.

12. The method of claim 11 in which said cross-linker is an organosiloxane radical.

13. The method of claim 12 in which said cross-linker comprises divinyltetramethyldisiloxane.

14. The method of claim 9, in which said hydrocarbon fuel includes an additive package.

15. The method of claim 9, wherein said antifoaming agent is dispersed prior to said addition to said hydrocarbon fuel.

16. The method of claim 15, wherein said antifoaming agent is dispersed in a dispersant selected from the group consisting of:

a) hydrocarbon fuel;
b) xylene;
c) toluene;
d) ketones;
e) esters; or
f) ethers.

17. A composition comprising:

a hydrocarbon fuel, where the hydrocarbon fuel is diesel fuel or jet fuel; and a density matched organopolysiloxane-polyoxyalkylene in an amount of 100 parts per million or less by volume of hydrocarbon fuel, wherein said density matched organopolysiloxane-polyoxyalkylene is selected from the group consisting essentially of:

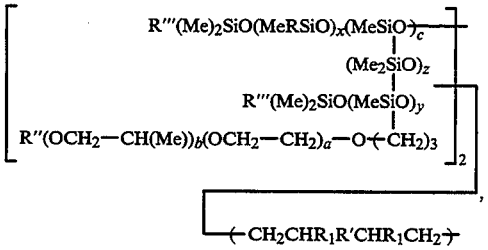

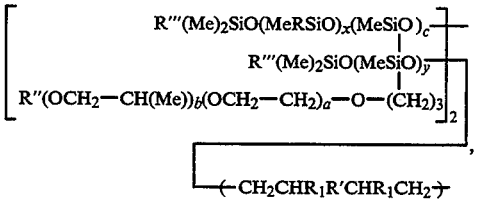

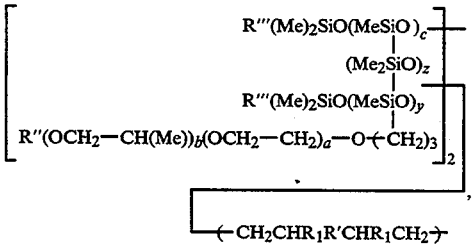

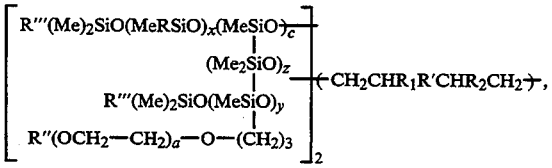

-continued

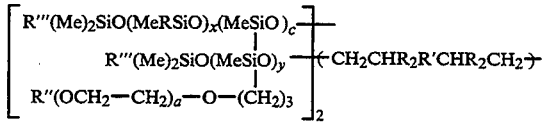

and

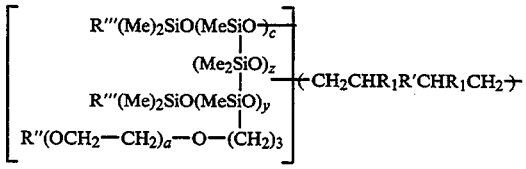

where:

Me is $CH_3$—;

R is 2 to 25 aliphatic carbon radicals;

R′ is selected from a group consisting essentially of:

(i) divalent organic radicals, and (ii) divalent organosiloxane groups, wherein (i) and (ii) do not contain hydrolyzable groups;

R″ is a terminal group;

R‴ is independently selected from the group consisting essentially of:

(i) hydrogen, and (ii) aliphatic carbon radicals having 1 to 25 carbon atoms;

$R_1$ is independently selected from the group consisting essentially of:

(i) hydrogen, and (ii) aliphatic carbon radicals having 1 to 3 carbon atoms;

each $x=1-200$;

each $c=1-5$;

each $z=1-600$;

each $y=1-40$;

$x+y+z \geqq 10$;

each $a=4-40$; and each $b=1-40$.

18. The composition of claim 17 wherein c is greater than 1 and there are up to six organopolysiloxane-polyoxyalkylene molecules cross-linked together.

19. The composition of claim 17 in which a cross-linker links the siloxane backbone of said organopolysiloxane-polyoxyalkylene molecules through a saturated silicon to carbon bond.

20. The composition of claim 19 in which said cross-linker is an organosiloxane radical.

21. The composition of claim 20 in which said cross-linker is divinyltetramethyldisiloxane.

22. The composition of claim 17, in which said hydrocarbon fuel includes an additive package.

* * * * *